US006430976B1

(12) United States Patent
Mitsuyama

(10) Patent No.: US 6,430,976 B1
(45) Date of Patent: Aug. 13, 2002

(54) ANTI-THEFT CONTAINER

(75) Inventor: Masuhiro Mitsuyama, Okayaken (JP)

(73) Assignee: Nisshin Co., Ltd., Okayamaken (JP)

( * ) Notice: Subject to any disclaimer, the term of this patent is extended or adjusted under 35 U.S.C. 154(b) by 0 days.

(21) Appl. No.: 09/499,447

(22) Filed: Feb. 7, 2000

(30) Foreign Application Priority Data

Feb. 19, 1999 (JP) ..... 11-084488

(51) Int. Cl.[7] ..... E05B 73/00

(52) U.S. Cl. ..... 70/57.1; 70/58; 70/63; 206/1.5; 206/308.2; 206/387.11

(58) Field of Search ..... 70/57.1, 58, 63; 206/1.5, 308.2, 387.11

(56) References Cited

U.S. PATENT DOCUMENTS 5,147,034 A * 9/1992 Broadhead et al. ..... 206/1.5
5,209,086 A 5/1993 Brüwiler ..... 70/57.1
5,368,162 A * 11/1994 Holmgren ..... 206/1.5 X
5,375,712 A * 12/1994 Weisburn ..... 206/1.5 X
5,680,782 A * 10/1997 Komatsu et al. ..... 70/57.1
5,762,187 A * 6/1998 Belden, Jr. et al. ..... 206/308.2
5,769,218 A * 6/1998 Yabe ..... 206/308.2
5,779,039 A * 7/1998 Ambrus ..... 206/308.2
5,823,341 A * 10/1998 Nakasuji ..... 206/387.11
5,850,752 A * 12/1998 Lax ..... 70/57.1 X
5,882,052 A * 3/1999 Whitehead ..... 292/80
5,934,114 A * 8/1999 Weisburn et al. ..... 70/57.1
6,076,667 A * 6/2000 Ambrus ..... 206/308.2
6,125,668 A * 10/2000 Belden, Jr. ..... 70/57.1

FOREIGN PATENT DOCUMENTS

EP 0609955 8/1994
EP 0729897 9/1996

* cited by examiner

*Primary Examiner*—Lloyd A. Gall
(74) *Attorney, Agent, or Firm*—Shoemaker and Mattare

(57) ABSTRACT

An anti-theft container which can help prevent a contained article from being easily stolen. The anti-theft container includes a casing having an access opening; a locking member with a substantially L-shaped cross section with a blocking piece with a backwards pulling movement covering the access opening of the casing; and a slidable member mounted on the casing, capable of locking the locking member in position to the access opening when being installed in position, and allowing the locking member to be pulled backwards from the access opening when not installed in position. With this anti-theft container, the contained article can be taken our only by using a special unlocking piece held by the owner. This anti-theft container can therefore effectively protect a contained article against theft.

6 Claims, 10 Drawing Sheets

ANTI-THEFT CONTAINER

BACKGROUND OF THE INVENTION

1. Field of the Invention:

This invention in general relates to article containers, and more particularly, to an article container which can help prevent a contained article from being easily stolen.

2. Description of Related Art:

Discs, such as CDs or DVDs, are typically contained in a flat box when they are displayed in a shop for sale or rent. Conventional disc boxes, however would allow the contained discs to be easily stolen.

One solution to the foregoing problem is to adhere theft-warning magnetic tags to the boxes. One drawback to this solution, however, is that the thieves could nevertheless open the boxes and steal the contained discs.

In view of this drawback, there exists a need for a disc box that can help prevent the contained articles from being easily stolen.

SUMMARY OF THE INVENTION

It is therefore an objective of this invention to provide an anti-theft container that can help prevent contained articles from being easily stolen.

In accordance with the foregoing and other objectives, the invention proposes a new container structure. The anti-theft container of the invention includes a casing having an access opening for placing an article therein. Further, the anti-theft container includes a locking member which has a substantially L-shaped cross section with a blocking piece which can be pulled backwards covering the access opening of the casing, and a slidable member mounted on the casing, capable of locking the locking member in position to the access opening when being installed in position, and allowing the locking member to be pulled backwards from the access opening when not fixed in position. Moreover, the anti-theft container of the invention includes a structure which has no backwards pulling movement capable of preventing the readily-installed slidable member from being pulled backwards; and an unlocking piece capable of disengaging the readily-installed slidable member from the structure which has no backwards pulling movement when being inserted in position.

The anti-theft container of the invention can help prevent the article contained therein from being stolen. With the invention, the article contained in this anti-theft container can be taken out only by using a special unlocking piece held by the owner. The invention can therefore effectively protect the contained article against theft.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1:
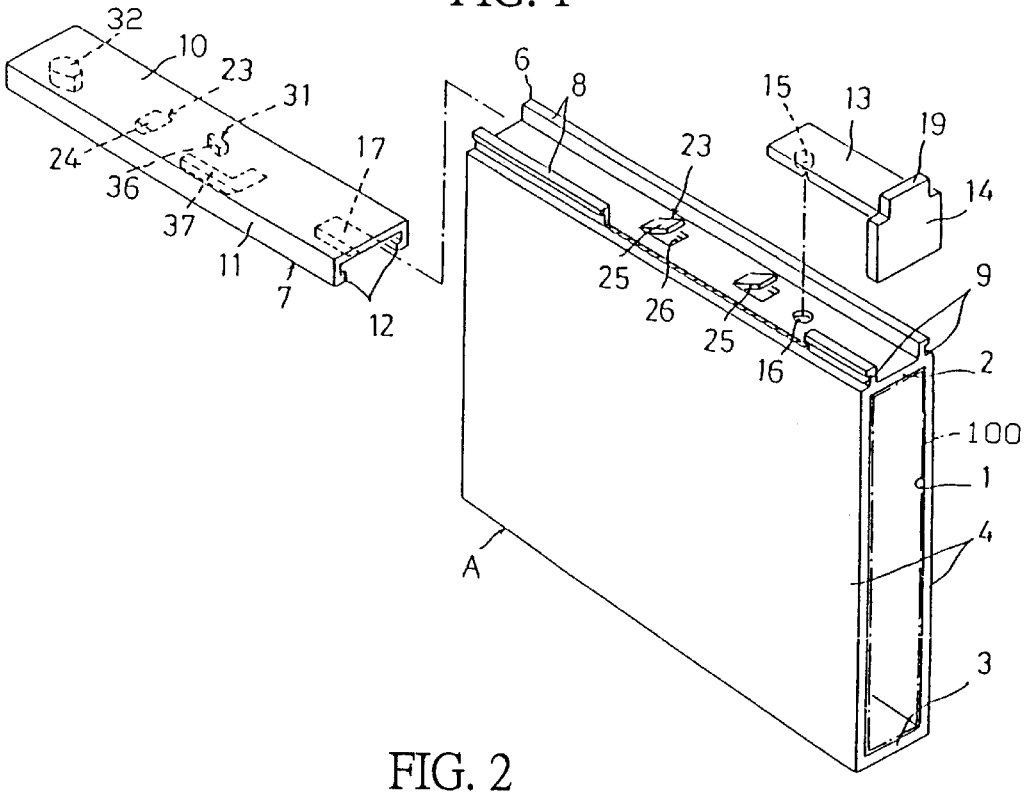
FIG. 1 is an exploded perspective view of one embodiment of the anti-theft container of the invention.

In accordance with the invention, several preferred embodiments are disclosed in the following with reference to the drawings.

First Preferred Embodiment

The first preferred embodiment of the anti-theft container of the invention is disclosed in the following with reference to FIGS. 1–3.

As shown, the anti-theft container includes a casing A having a hollowed space defined by a top plate 2, a bottom plate 3, and two sidewalls 4. The casing A is used to hold an article 100 which can be accessed via an access opening 1.

The top plate 2 of the casing A is formed with a guide slot 6 on which a slidable member 7 is installed. The slidable member 7 is an integral body of an elongated piece 10 and two side walls 11 having inwardly protruded portions 12. The guide slot 6 includes oppositely arranged upright walls 8 whose outer sides are formed with slits 9 in which the inwardly protruded portions 12 of the side walls 11 of the slidable member 7 can be fitted to allow the slidable member 7 to move along the top plate 2 of the casing A.

In the embodiment of FIG. 1, the slidable member 7 is mounted on the top plate 2 of the casing A; but it can also be mounted on the side wall 4.

The anti-theft container further includes a locking member 13 whose cross-section is substantially L-shaped. The locking member 13 is installed on the top plate 2 where the slidable member 7 is installed. The locking member 13 is formed with a blocking piece 14 and a stopper 19. The blocking piece 14 is normally positioned in such a manner so as to block the access opening 1 of the casing A to prevent the article 100 contained in the casing A from being taken out. The locking member 13 is formed with a peg 15, and correspondingly, the top plate 2 is formed with a hole 16 to accept the peg 15, allowing the locking member 13 to be fitted onto the top plate 2 by means of this peg-and-hole structure.

The slidable member 7 is formed with a protruded portion 17 on the front end thereof. As shown in FIG. 2, when the slidable member 7 is pushed to the extreme end, i.e., when it is entirely positioned on the top plate 2, the slidable member 7 is stopped by the stopper 19 and its protruded portion 17 is engaged with the locking member 13, thereby locking the locking member 13 in position.

Figure 3:
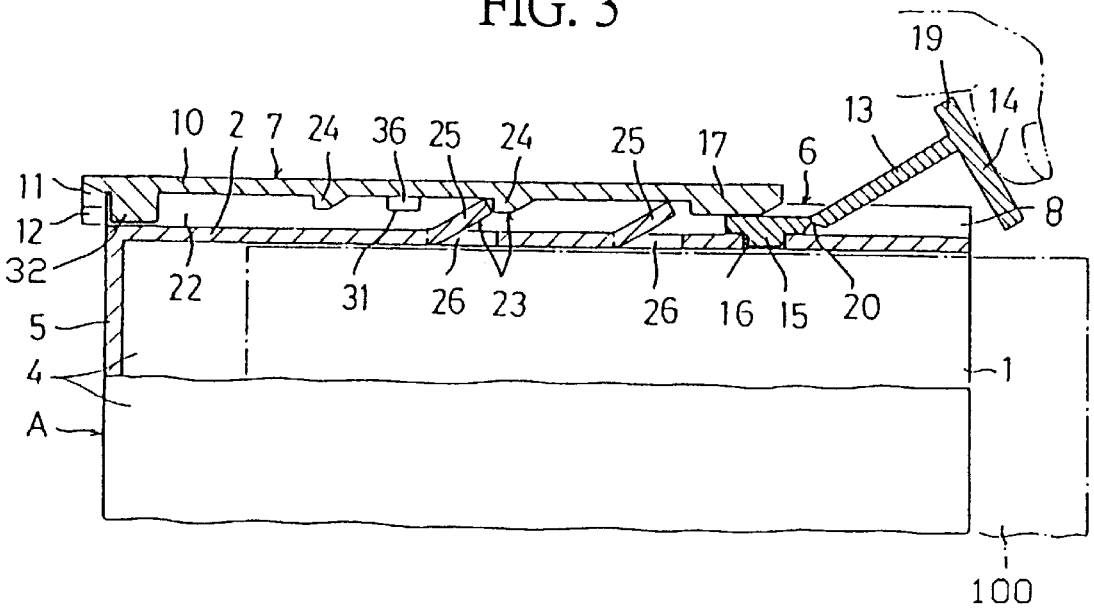
FIG. 3 is a schematic sectional diagram of the same of FIG. 2 except when the locking member is unlocked position.
Figure 4:
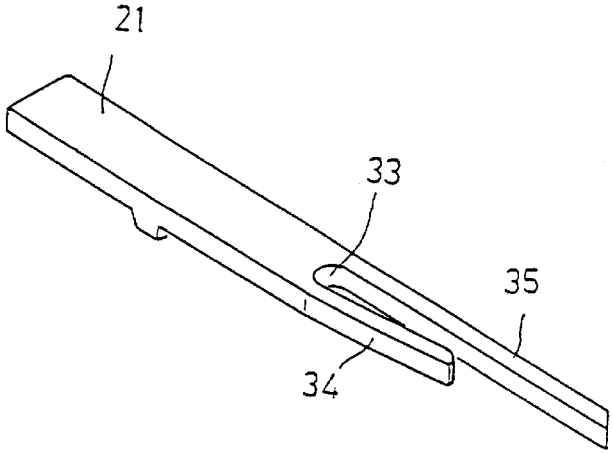
FIG. 4 is a schematic perspective view of an unlocking piece utilized in one embodiment of the invention.
Figure 5:
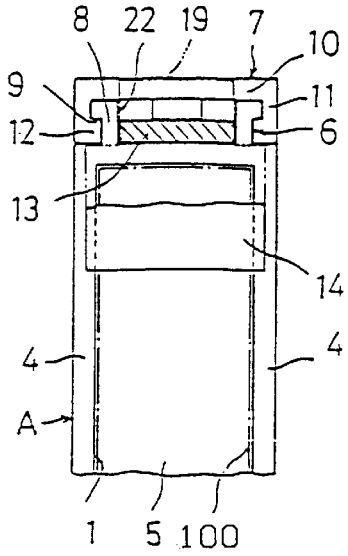
FIG. 5 is a schematic lengthwise sectional view of the anti-theft container of the invention.

As shown in FIG. 3, when the slidable member 7 is pulled backwards, it unlocks the locking member 13, thus allowing the locking member 13 to be flipped up by the user's finger to draw the blocking piece 14 away from the access opening 1 of the casing A. This allows the user to take out the article 100 via the access opening 1 which the blocking piece 14 no longer blocks.

Figure 2:
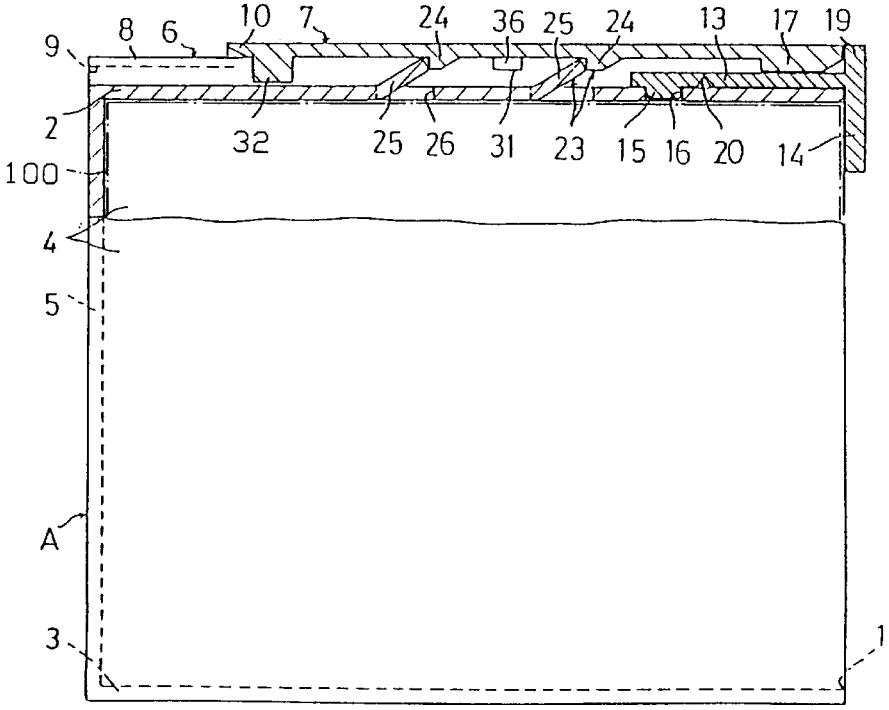
FIG. 2 is a schematic sectional view of the anti-theft container of the invention when its locking member is locked in position.

When the article 100 is put back into the casing A, the user can put the blocking piece 14 in front of the access opening 1 and then push the slidable member 7 forwards to lock the locking member 13, and thus the blocking piece 14, in position, as illustrated in FIG. 2. This prevents the article 100, contained in the casing A, from being taken out.

Since the user is required to simultaneously use one hand to pull the slidable member 7 backwards and the other hand to flip up the blocking piece 14, the article 100 is difficult to remove. Therefore, the invention can help prevent the article 100 from being easily stolen.

Second Preferred Embodiment

As shown in FIGS. 2 and 3, the anti-theft container of the invention can be additionally formed with a hinged portion 20 in the back surface of the locking member 13 near the rear end of the locking member 13. This hinged portion 20 can be, for example, a groove structure having a substantially V-shaped cross section.

The forming of the hinged portion 20 allows the locking member 13 to be more effortlessly flipped up to open the access opening 1.

Third Preferred Embodiment

In accordance with the third preferred embodiment, the anti-theft container of the invention further includes the use of an unlocking piece 21 which is insertable into the receptacle portion 22 defined between the slidable member 7 and the top plate 2. Further, the anti-theft container of the invention is formed with a structure 23 which has no backwards pulling movement and includes a plurality of upward-bent portions 25 on the top plate 2 and a plurality of corresponding stopper portions 24 on the slidable member 7. When the unlocking piece 21 is entirely inserted into the receptacle portion 22, it can flatten the upward-bent portion 25 of structure 23 which can not be pulled backwards, thereby allowing the slidable member 7 to be now pulled backwards.

With the foregoing structure, the slidable member 7 can be fixed in position on the top plate 2 by the structure 23 which prevents a backwards pull, so that the locking member 13 can be prevented from being flipped up to allow the article 100 contained in the casing A to be taken out. When the user desires to take out the article 100, he can simply insert the unlocking piece 21 into the receptacle portion 22 so as to disengage the upward-bent portion 25 of structure 23, which prevents a backwards pull, from the stopper 24, thus allowing the unlocking piece 21 to be pulled backwards to allow the blocking piece 14 of the locking member 13 to be flipped up.

Fourth Preferred Embodiment

As shown in FIGS. 1–8 in this embodiment, the anti-theft container of the invention is further formed with a stopper structure 31 in the receptacle portion 22 and a corresponding escaping structure 32 on the unlocking piece 21.

Figure 6:
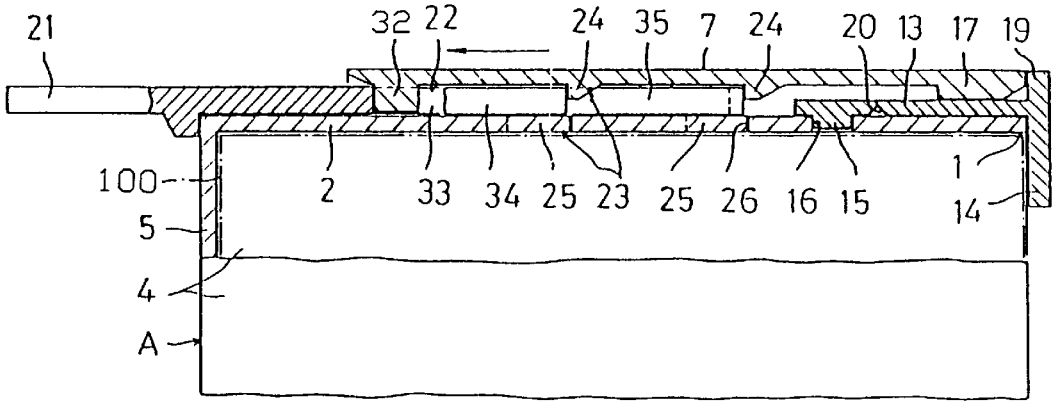
FIG. 6 is a schematic sectional view of one embodiment of the anti-theft container of the invention.

The stopper structure 31 includes a protruded portion on the back side of the elongated piece 10 of the slidable member 7 and another protruded portion 31 in the middle of the back side of the slidable member 7. The escape structure 32 on the unlocking piece 21 is a fork-like structure having a cutaway portion 33 separating a first finger 34 and a second finger 35 which is greater in length than the first finger 34. The stopper structure 31 can be fitted in the cutaway portion 33. During the course of inserting the unlocking piece 21, it will be stopped by the stopper structure 31. At this position, the first finger 34 has its front end abutted on the upward-bent portion 25, while the second finger 35 has its front end urged against the upward-bent portion 25, as illustrated in FIG. 6. As a result, the stopper 24 is disengaged from the upward-bent portion 25.

Figure 7:
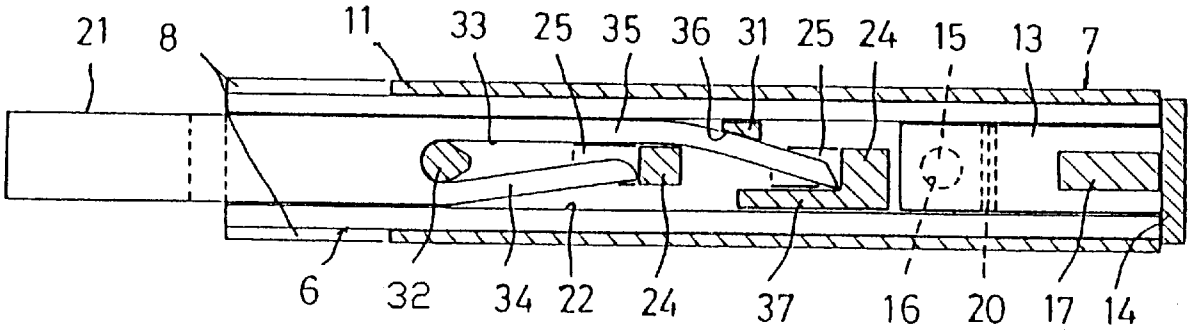
FIG. 7 is a schematic crosswise sectional view of the anti-theft container of the invention.
Figure 8:
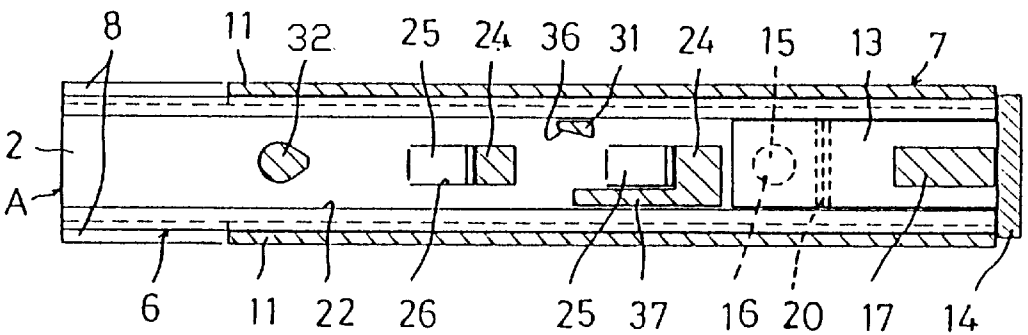
FIG. 8 is a schematic crosswise sectional view of the anti-theft container of the invention when the unlocking piece is uninserted.

Further, as shown in FIG. 7, when the unlocking piece 21 is inserted in position, the escape structure 32 is substantially aligned to the two upward-bent portions 25, and the front end of the first finger 34 urges against the upward-bent portion 25 to cause the upward-bent portion 25 to bend inwards. Moreover, the second finger 35 urges a bend inwards by the slanted surface 36 of the front stopper structure 31 and thereby an abutment on the upward-bent portion 25. The unlocking piece 21 is preferably made of resin so as to provide elasticity to the first finger 34 and the second finger 35 to allow them to be easily bendable.

The forgoing provision can further help prevent the anti-theft container of the invention from being easily opened up.

Fifth Preferred Embodiment

Figure 9:
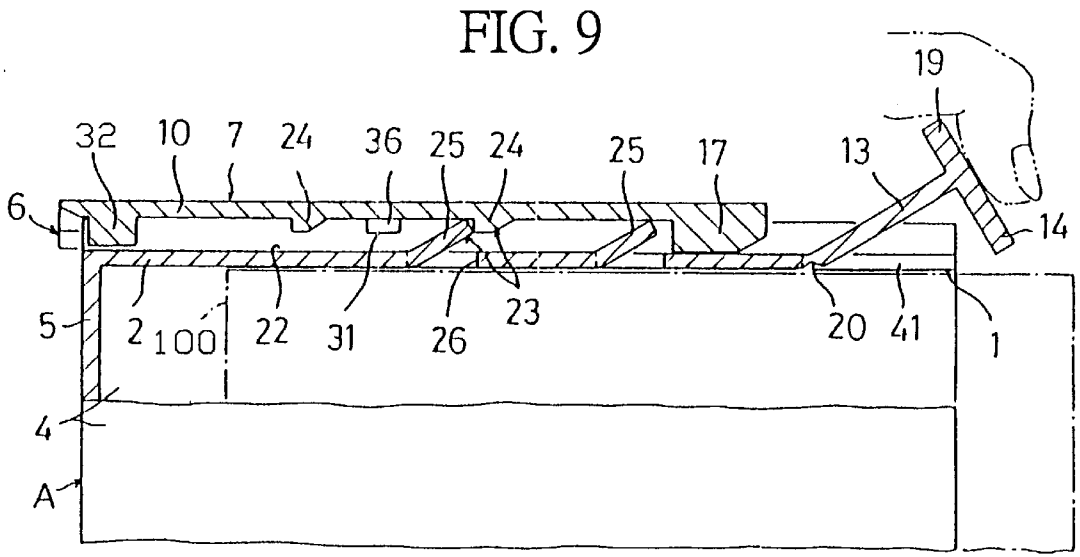
FIG. 9 is a schematic crosswise sectional view of one embodiment of the anti-theft container of the invention.
Figure 10:
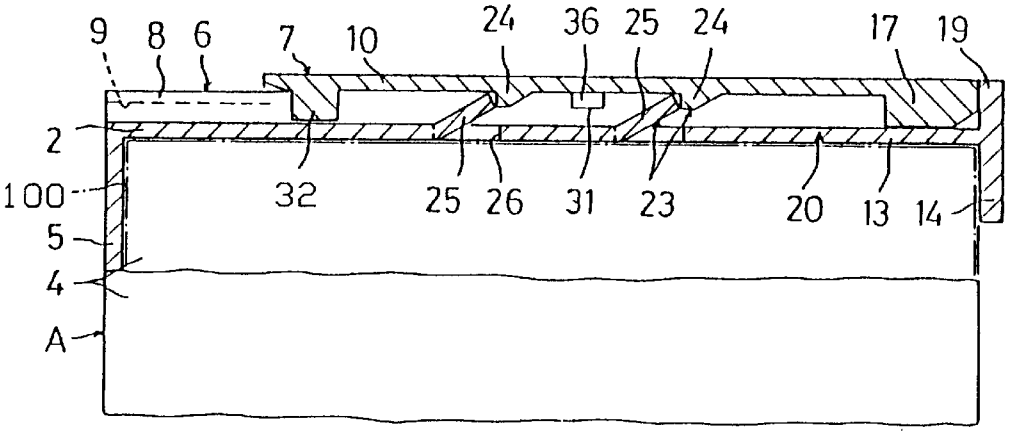
FIG. 10 is a schematic sectional view of the anti-theft container of the invention when moving the slidable member forwards.
Figure 11:
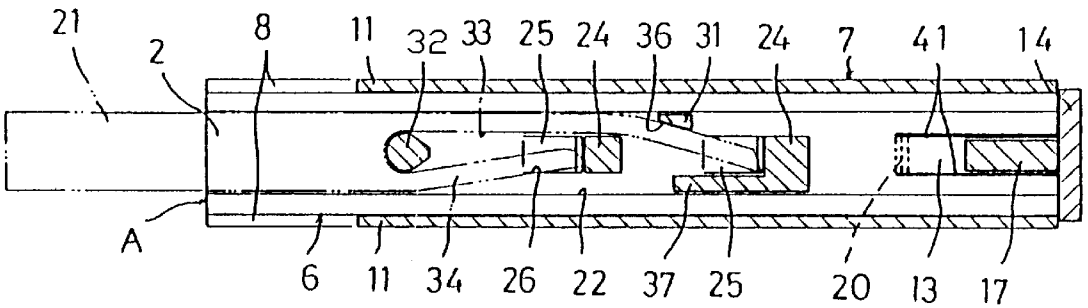
FIG. 11 is a schematic crosswise sectional view of the anti-theft container of FIG. 10.

Referring to FIGS. 9, 10, and 11, in this embodiment, the locking member 13 is integrally formed with the casing A. Further, two slits 41 are formed in the top plate 2, with the part between these two slits 41 serving as the locking member 13.

Moreover, a hinged portion 20 is formed near the rear end of the locking member 13 to allow the blocking piece 14 to be easily bendable when the blocking piece 14 is being pulled backwards.

The blocking piece 14 can be elongated so as to allow the blocking piece 14 to be urged by the article 100 when the article 100 is being pulled out of the casing A. This provision allows the locking member 13 to be pulled backwards without having to be pulled by the blocking piece 14.

Sixth Preferred Embodiment

Referring to FIGS. 12, 13, 14, and 15, in this embodiment, the locking member 13 can be restored to its original position when it is not pressed by the slidable member 7. This can be achieved by forming the locking member 13 into a elastically curved shape.

Figure 12:
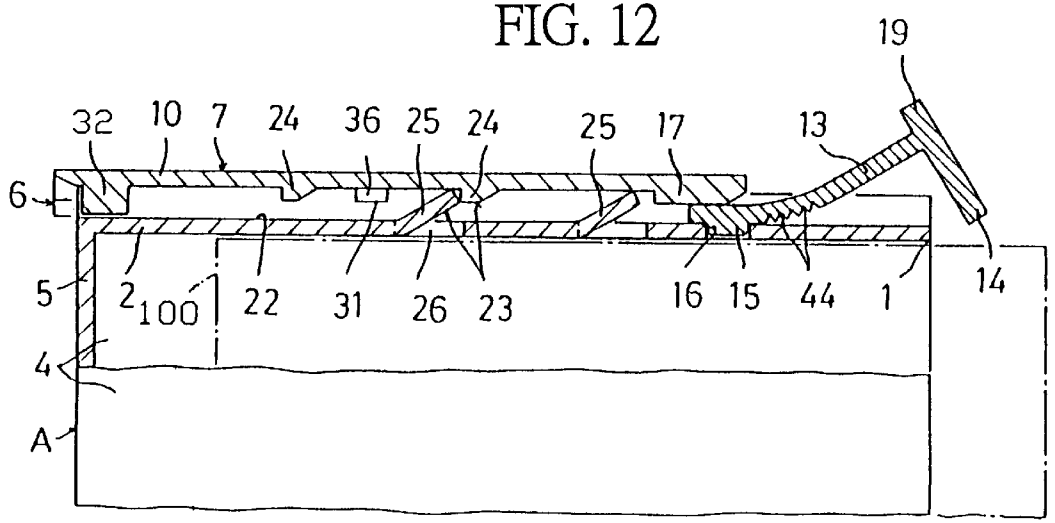
FIG. 12 is a schematic sectional diagram of one embodiment of the anti-theft container of the invention.

As shown in FIG. 12, when the slidable member 7 is pulled backwards, the locking member 13 allows the blocking piece 14 to be withdrawn from the access opening 1 without requiring the user to do it by hand.

Figure 13:
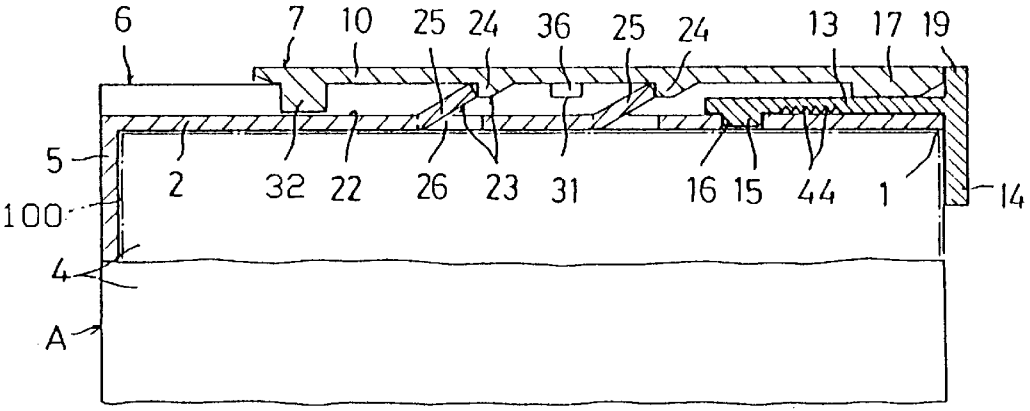
FIG. 13 is a schematic sectional view of the anti-theft container of the invention when moving the slidable member forwards.

As shown in FIG. 13, when the slidable member 7 is moved forwards, it can urge against the locking member 13 and thereby flatten the locking member 13 into a biased state.

Figure 14:
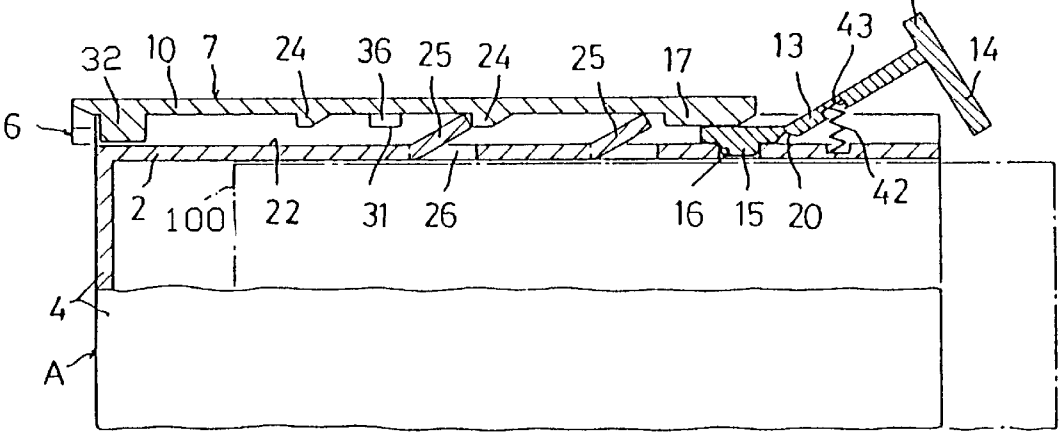
FIG. 14 is a schematic sectional diagram of one embodiment of the anti-theft container of the invention.
Figure 15:
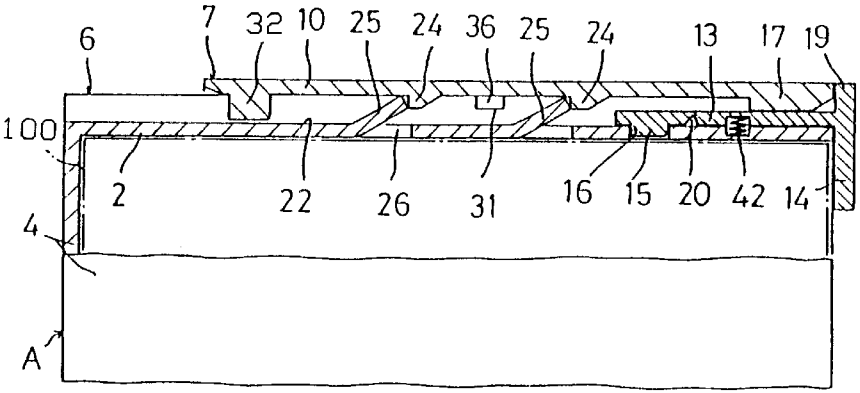
FIG. 15 is a schematic sectional diagram of the anti-theft container of the invention when moving the slidable member forwards.
Figure 16:
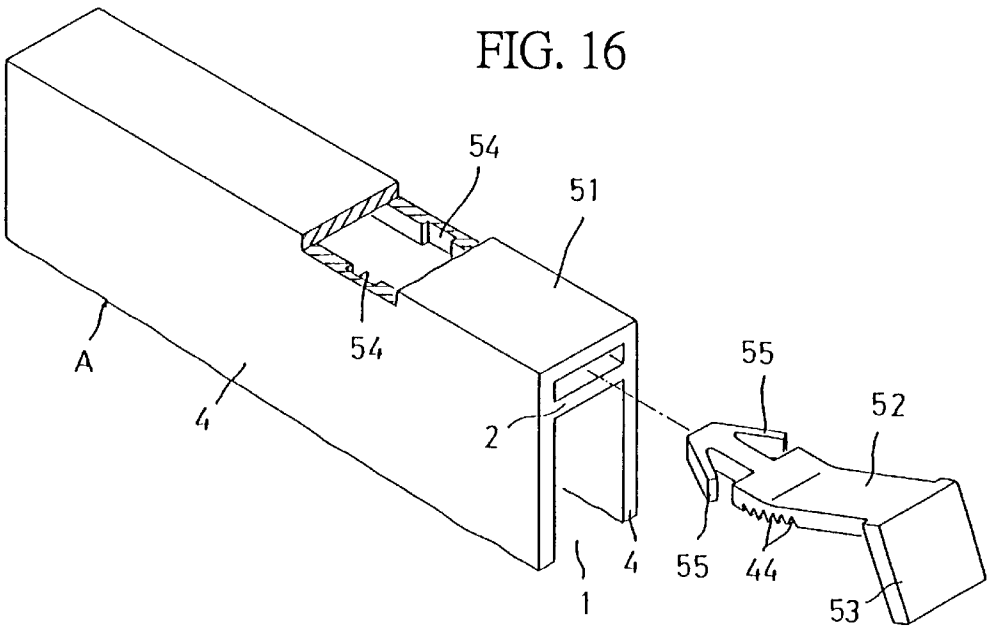
FIG. 16 is a schematic sectional diagram of one embodiment of the anti-theft container of the invention.

Alternatively, the restorable capability of the locking member 13 can be achieved by providing a spring 42 between the locking member 13 and the top plate 2, as shown in FIGS. 14 and 15. Further, a plurality of crosswise grooves 44 can be formed on the back side of the locking member 13, which can help reduce the resistance of the locking member 13 against the slidable member 7.

Seventh Preferred Embodiment

Referring to FIGS. 16, 17, 18, 19, and 20, in this embodiment, the anti-theft container of the invention includes an insertion member 52 having an anchoring structure 55. The insertion member 52 is insertable through a guide structure 51 formed on opposite ends of the access opening 1. After being inserted in position, the insertion member 52 can not be pulled backwards due to its anchoring structure 55 being fitted in and stopped by the recessed portion 54. A blocking piece 53 is provided at the front end of the guide structure 51 in front of the insertion member 52 for the purpose of preventing the article 100 contained in the casing A from being taken out through the access opening 1.

Figure 17:
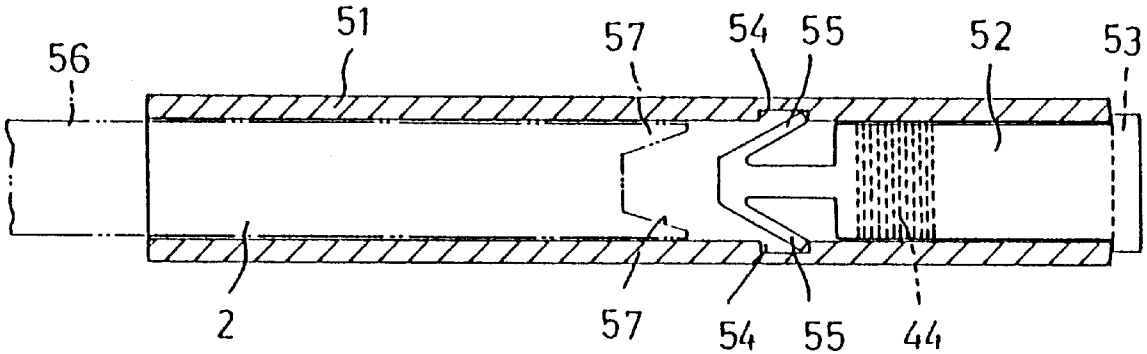
FIG. 17 is a schematic sectional diagram of the anti-theft container of the invention when inserting the unlocking piece.
Figure 18:
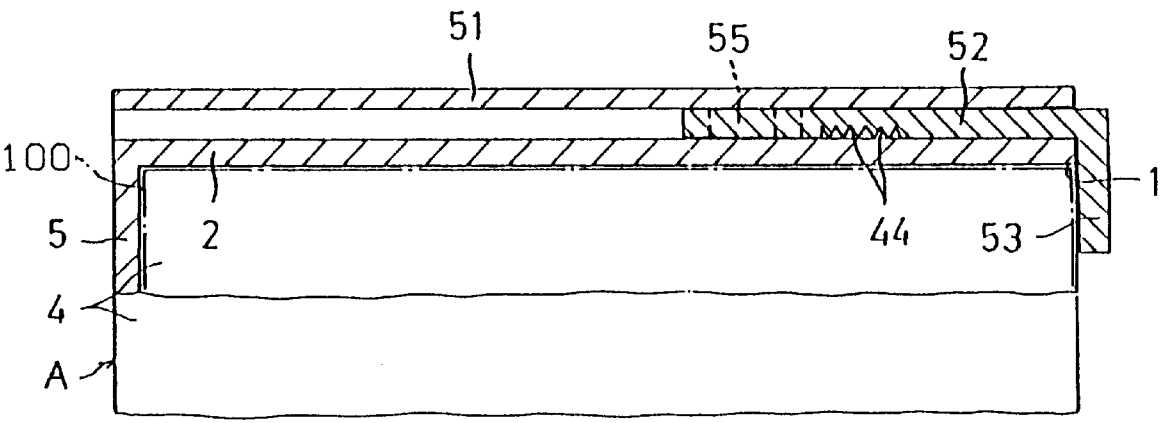
FIG. 18 is a schematic sectional diagram of the anti-theft container of FIG. 17.
Figure 19:
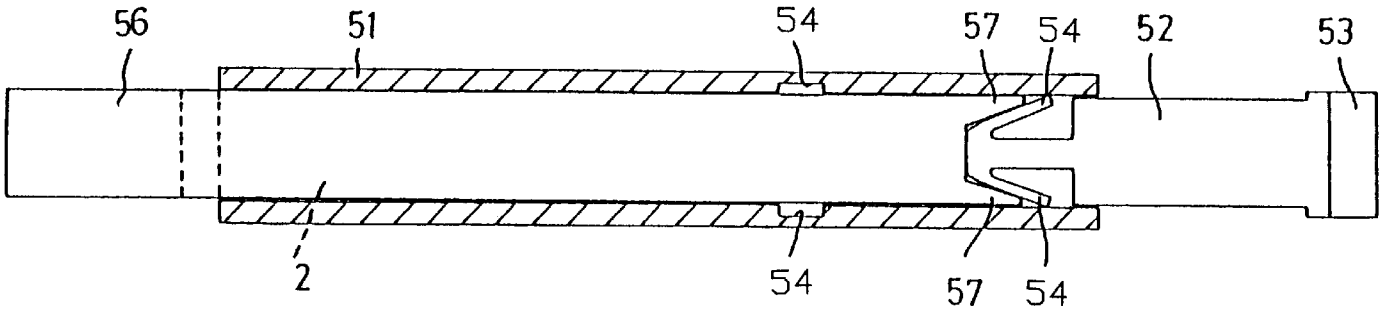
FIG. 19 is a schematic sectional diagram of the anti-theft container of the invention when the unlocking piece is pulled backwards.

As shown in FIG. 18, when the insertion member 52 is inserted into the guide structure 51, the blocking piece 53 will be urged to close the access opening 1; and meanwhile, the anchoring structure 55 is fitted into the recessed portion 54, as shown in FIG. 17, whereby the insertion member 52 is prevented from being pulled backwards, allowing the blocking piece 53 to be fixed in position in front of the access opening 1, thus preventing the article 100 contained in the casing A from being withdrawn to the outside.

To allow the insertion member 52 to be pulled backwards, the user can insert an unlocking piece 56 into the guide structure 51. The unlocking piece 56 is an elongated piece having a tapered recessed portion 57 formed in the front end thereof. During the course of insertion, the tapered recessed portion 57 can first disengage the anchoring structure 55 from the recessed portion 54 and then push against the anchoring structure 55 to thereby push the insertion member 52 backwards. After the insertion member 52 is pulled backwards, the article 100 can then be withdrawn from the casing A.

Figure 20:
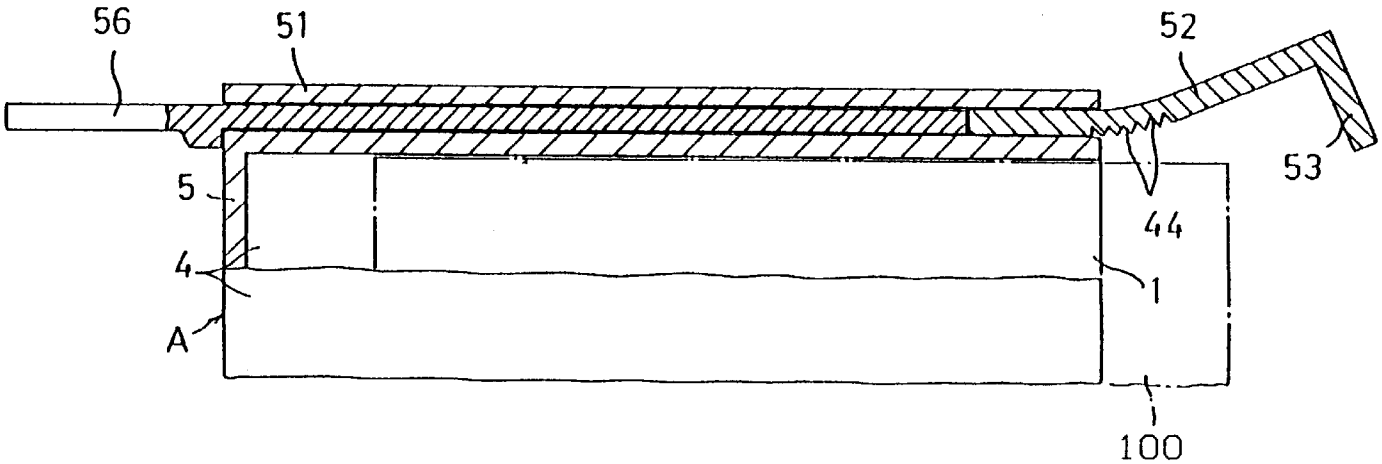
FIG. 20 is a schematic sectional diagram of the anti-theft container of FIG. 19.

Further, as shown in FIG. 20, in the case of the insertion member 52 being formed with grooves 44, the blocking piece 53 can be pulled backwards from the access opening 1 once the unlocking piece 56 is inserted in position, thereby uncovering the access opening 1, allowing the article 100 to be withdrawn from the casing A.

Conclusion

In conclusion, the invention provides an anti-theft container which can prevent the article contained therein from being stolen away. With the invention, the article contained in this anti-theft container can be taken out only by using a special unlocking piece held by the owner. The invention can therefore effectively protect the contained article against theft.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A anti-theft container comprising a casing having an access opening, a locking member with a substantially L-shaped cross-section having a blocking piece that can be pulled backwards covering the access opening of the casing, a slidable member capable, when installed on the container, of locking the locking member in position over the access opening, and allowing the locking member to be retracted from the access opening when not installed on the container, a structure for preventing the installed slidable member from being removed from the container by being pulled backwards, said structure comprising a pair of stops disposed on the slidable member and first and second upward-bent portions formed on the casing for engaging the stops, and an unlocking piece capable of disengaging the installed slidable member from the structure which prevents a backwards pulling movement when being inserted in position, said unlocking piece comprising a fork-like escape element having a pair of spaced fingers separated by a cutaway portion whereby, when the fingers are inserted between the slidable member and the casing, the cutaway portion is arrested by one of the stops at a position where the first finger has its front end urged against the first upward-bent portion, while the second finger has its front end urged against the second upward-bent portion, thereby allowing the stops to be disengaged from the upward-bent portions.

2. The anti-theft container of claim 1, wherein the locking member has a hinged portion.

3. The anti-theft container of claim 1, wherein the locking member is installed in position to the casing by means of a peg-and-hole structure.

4. The anti-theft container of claim 1, wherein the locking member is integrally formed with the casing.

5. The anti-theft container of claim 1, wherein the locking member is provided with restorability which allows the locking member to be restored to its original position when not pressed by the slidable member.

6. An anti-theft container comprising a casing having an access opening, an insertion member with an anchoring structure having a blocking piece which can be pulled backwards from a position covering the access opening of the casing and being insertable through a guide structure formed on opposite ends of the access opening, and which, while being inserted in position, cannot be pulled back as the anchoring structure being fitting in and stopped by a recessed portion with the guide structure, and an unlocking piece capable of disengaging the anchoring structure from the recessed portion, thereby pushing the insertion member backwards when inserted into the guide structure.

* * * * *